United States Patent [19]

Blucher et al.

[11] 3,931,375

[45] Jan. 6, 1976

[54] PRODUCTION OF METAL POWDER

[75] Inventors: Joseph T. Blucher, Waltham, Mass.; Donald D. Dalrymple, North Warren, Pa.

[73] Assignee: Industrial Materials Technology, Inc., Woburn, Mass.

[22] Filed: Apr. 24, 1974

[21] Appl. No.: 463,656

Related U.S. Application Data

[62] Division of Ser. No. 344,040, March 22, 1973, Pat. No. 3,830,603.

[52] U.S. Cl. ..... 264/10; 264/24

[51] Int. Cl.[2] ..... B22D 23/08

[58] Field of Search ..... 264/10, 24

[56] References Cited

UNITED STATES PATENTS

| | | | |
|---|---|---|---|
| 2,897,539 | 8/1959 | McMillan | 264/10 |
| 3,021,562 | 2/1962 | Chisholm | 264/10 |
| 3,041,672 | 7/1962 | Lyle | 264/10 |

*Primary Examiner*—Robert F. White
*Assistant Examiner*—J. R. Hall
*Attorney, Agent, or Firm*—Alfred L. Michaelsen

[57] ABSTRACT

Small particles of metal, such as those used in making powder metal compacts, are produced by feeding the end of a metal wire or rod against the edge of a rotating disc and causing a direct electrical current to flow through the wire and disc. This melts the end of the wire and also creates a magnetic field about the wire. The rotation of the disc breaks the electrical contact and forms an arc which causes additional melting of the wire. Contact between the wire and disc takes place within a second electromagnetic field. Continuously advancing the end of the wire causes the intermittent making and breaking of electrical contact. The interaction of the two magnetic fields causes the molten particles to be removed from the area of contact. Means are provided for cooling and collecting the metal particles and for preventing the accumulation of solidified metal particles on the electromagnet or the rotating disc. Vacuum conditions may be used, thus producing a powder of high purity.

3 Claims, 4 Drawing Figures

PRODUCTION OF METAL POWDER

This is a division of application Ser. No. 344,040 filed Mar. 22, 1973, now U.S. Pat. No. 3,830,603.

BACKGROUND OF THE INVENTION

This invention relates to an improved method for the production of metal powder from solid material such as metal wire of rod.

Fine metal powders is being used increasingly in the manufacture of parts by powder metallurgical techniques. Many methods of making metal powders have been proposed. These include the atomization of molten metal by gas jets (Helin et al., U.S. Pat. No. 3,428,718) or by high pressure water (Huseby, Pat. No. 3,325,277); spraying molten metal into a vacuum to form discrete particles (Wentzell, Pat. No. 3,510,546); the vaporization of metal in a vacuum followed by condensation (Allen et al. Pat. No. 3,049,421); the fusion of metal by an electric arc followed by the formation of condensed droplets which may be forced out of the arc zone either by means of a gas stream (Lezberg et al. Pat. No. 2,795,819, Schoop, Pat. No. 1,133,508) or by centrifugal force either alone (Chisholm et al., Pat. No. 3,021,562, McMillan, Pat. No. 2,897,539) or coupled with the influence of the magnetic repulsion inherent in the arc (Bridger, Pat. No. 1,887,577); forming a molten surface on a metal rod and agitating the molten metal at ultrasonic frequency generated either by an ultrasonic transducer or by use of a high frequency electric current coupled with a strong direct current magnetic field (Newberry, Pat. No. 3,275,787).

In addition it is known to form glass beads by passing an electric current through a stream of molten glass to cause an arc and subjecting the stream in the area of the arc to the action of the magnetic field of an electromagnet (Guyer et al., Pat. No. 3,313,608). In this latter method the interaction of the magnetic field produced by the electrical current in the current-carrying glass and the magnetic field caused by the electromagnet causes an intermittent making and breaking of the arc which in turn agitates the stream and causes the formation of glass beads.

In several of these prior art devices the process is carried on either in the presence of an inert gas (Lezberg et al., Pat. No. 2,795,819, Chisholm et al., Pat. No. 3,021,562, Newberry, Pat No. 3,275,787) or in a vacuum (Wertzell, Pat. No. 3,510,546, Allen et al., Pat. No. 3,049,421, McMillan, Pat. No. 2,897,539).

SUMMARY OF THE INVENTION

The object of the present invention is to produce fine metal powder from a wire or rod by forming particles of molten metal in an electric arc and removing the formed particles by the interaction of two magnetic fields operating at right angles to one another. The operation may take place in a vacuum chamber thus eliminating the chance of contamination by, for example, the formation of oxides.

By the use of conventional wire feeding apparatus a wire or rod with the chemical analysis desired in the final powder product is brought into contact with a disc which is rotating in a strong magnetic field produced by an electromagnet. The wire and disc are attached to a source of direct current and sufficient voltage is impressed across them to cause electrical current to flow through the circuit to produce the required heat at the point of contact between the wire and disc to rapidly melt the metal. The flow of current through the wire produces a magnetic field around the Wire. This field interacts with the magnetic field produced by the electromagnet to force the metal particles away from the point of contact between the wire and the rotating disc. The cooled and solidified particles are thereafter collected.

Means are provided for cooling the apparatus and for avoiding the tendency of the powder particles to agglomerate between the pole pieces of the electromagnet. In addition, means are provided to remove any build up of powder particles which may form on the rotating disc.

A more complete understanding of our invention may be gained from the following description and from the annexed drawings.

DESCRIPTION OF THE PREFERRED EMBODIMENT

Figure 1:
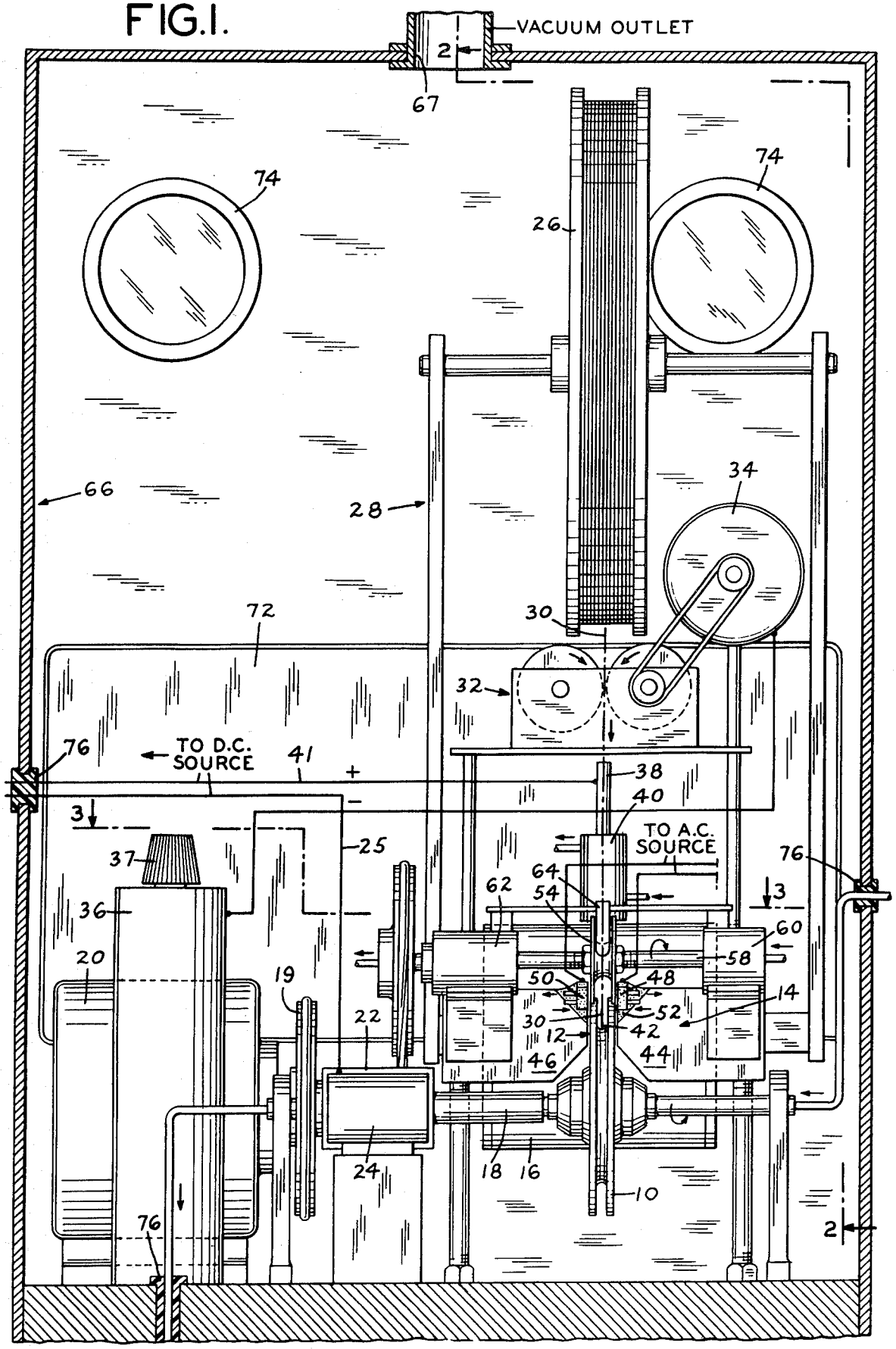
FIG. 1 illustrates a front elevational view of apparatus, partly in section, embodying features of this invention.

Referring to the drawings, a deeply grooved disc 10 is placed in the gap 12 of electromagnet 14 energized by coil 16. The disc is mounted for rotation on water-cooled shaft 18 driven through pulley 19 by motor 20. Each end of shaft 18 is provided with vacuum-tight rotary joints (not shown). Electrical current is supplied to disc 10 by means of a slip ring 22 mounted on shaft 18 in contact with carbon brush 24 which in turn is connected by conductor 25 to the negative terminal of a source of direct current (not shown).

A wire reel 26 is mounted for rotation in frame 28. Metal wire 30 having a chemical composition of that desired in the final powder product is drawn from the reel by a conventional wire feeder 32 powered by a variable speed motor 34 controlled by electronic controller 36 adjustable through knob 37. Wire 30 is fed downwardly through guide tube 38 water cooled by housing 40. Electrical current is supplied to wire 30 through guide tube 38 which is connected by conductor 41 to the positive terminal of the source of direct current that supplies current to disc 10.

Thus, when the tip 42 of wire 30 makes contact with the disc 10, a closed electrical circuit is formed from the positive terminal of the direct current source through conductor 41 to guide tube 38 to wire 30 through tip 42 to disc 10 to shaft 18 to slip ring 22 to carbon brush 24 and through conductor 25 to the negative terminal of the direct current source.

When the wire 30 makes contact with the disc 10 the current flow between the advancing tip 42 and disc 10 causes the tip 42 to melt. This melting action together with rotation of the disc 10 breaks the contact between wire 30 and disc 10 and causes the formation of an arc. The arc creates a high temperature which melts an additional portion of the continuously advancing wire. The end of the continuously advancing wire again makes contact with the rotating disc, extinguishing the arc. The tip of the wire melts, and again, the combined melting action and the rotation of the disc 10 causes the breaking of the contact and reformation of the arc. This making and breaking of the arc with the attendant formation of molten metal particles 47 continues at a relatively rapid rate.

The flow of electrical current through the wire 30 produces a magnetic field around the wire in accordance with well known principles of electricity and magnetism. The direction of feed of the wire is substantially perpendicular to the axis of rotation of the disc 10 and in addition is substantially perpendicular to the lines of magnetic force (not shown) in the gap 12 between pole pieces 44 and 46 of electromagnet 14.

The metal particles 47 formed are driven out of the area of contact between the metal wire and the disc due to the interaction between the magnetic field produced by the passage of an electrical current in the wire and the second magnetic field transverse thereto produced by the electromagnet.

Figure 2:
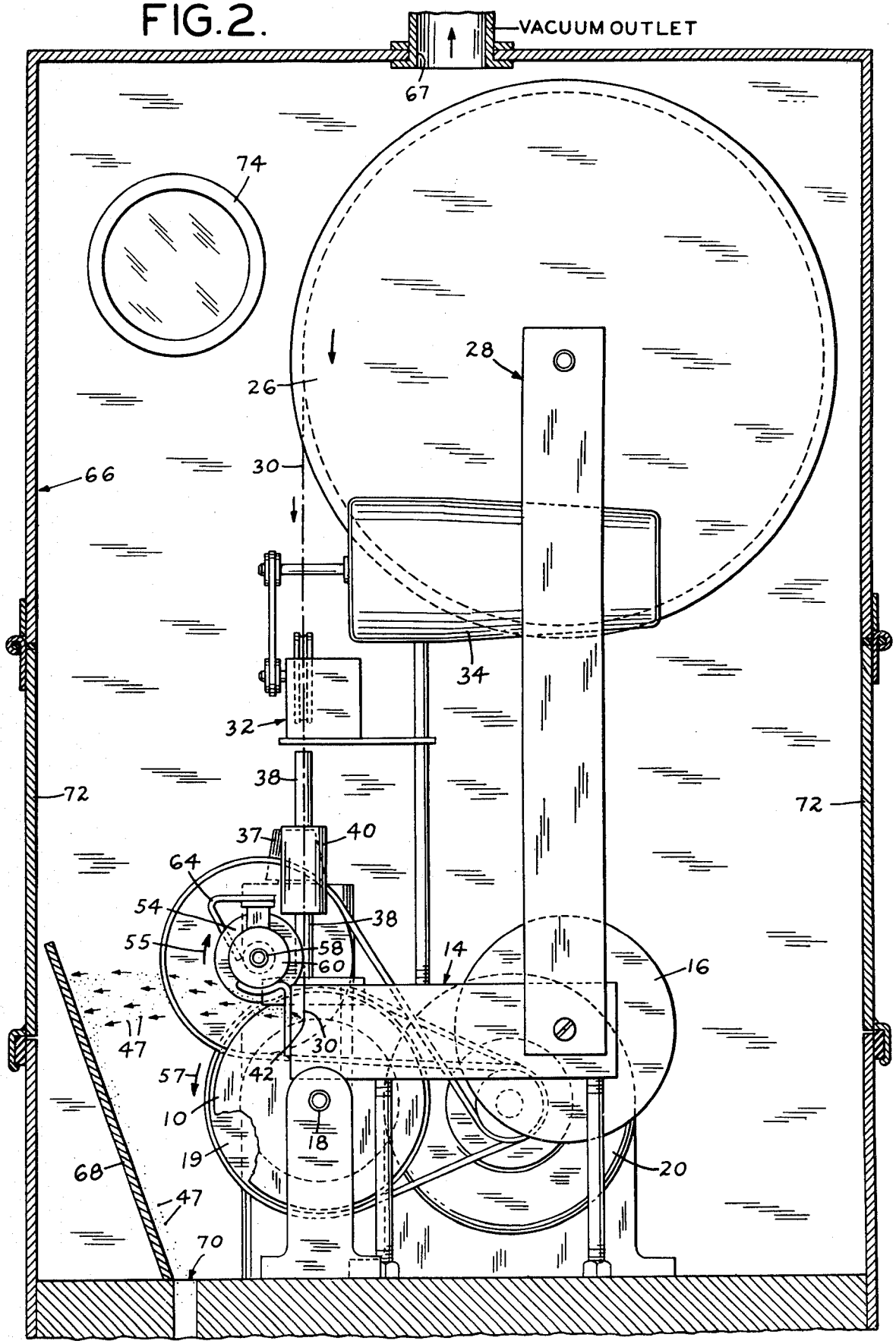
FIG. 2 is a vertical section taken generally along the line 2—2 of FIG. 1, with water cooling pipes and electrical connections omitted.
Figure 3:
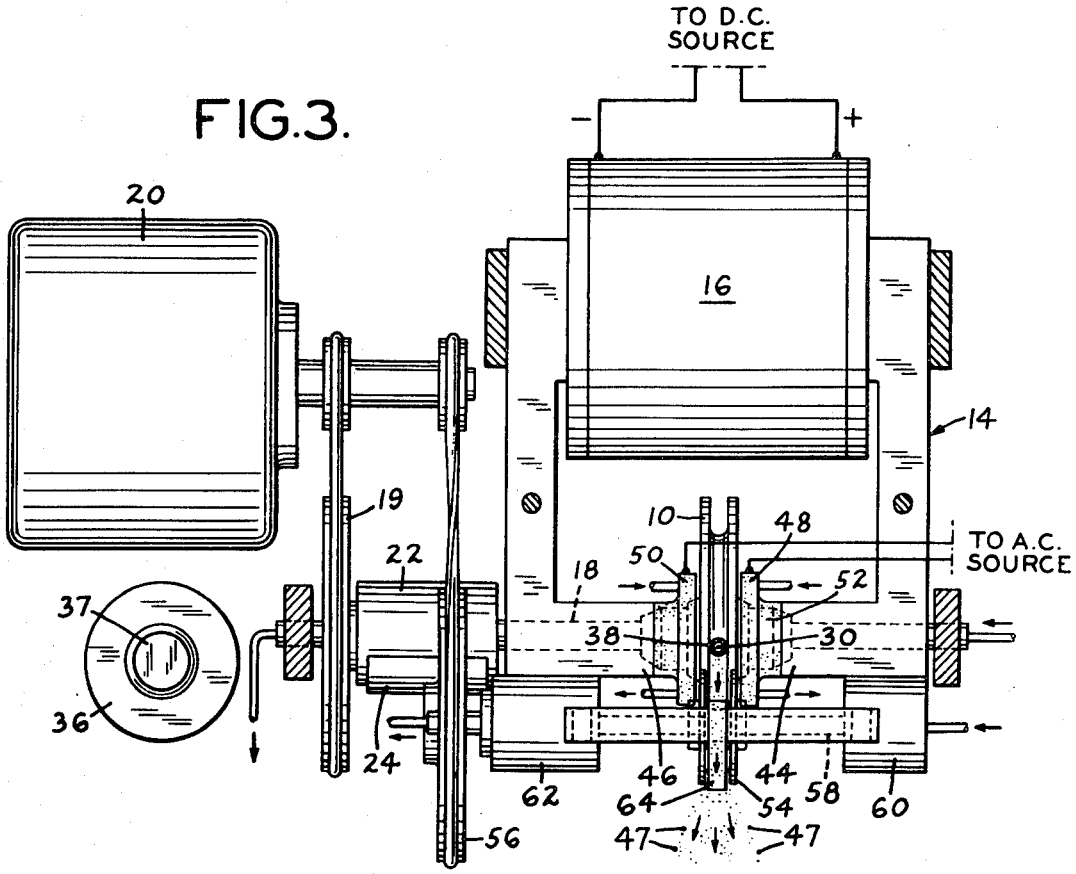
FIG. 3 is a horizontal section taken generally along the line 3—3 of FIG. 1.
Figure 4:
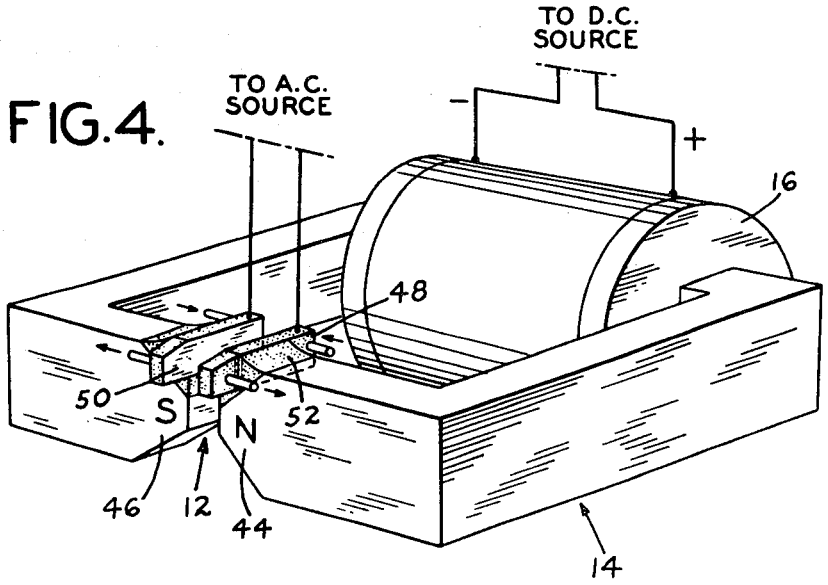
FIG. 4 is a perspective view of the electromagnet and water-cooled copper terminals utilized in the invention.

As shown in FIG. 2 the direction in which the metal particles 47 are flung by the interaction of the two magnetic fields is shown by the directional arrows as being from right to left and generally perpendicular to the axis of rotation of the disc 10. In the embodiment shown the pole piece 44 is "north" and the pole piece 46 is "south". Reversal of these pole pieces will cause the molten particles to be thrown from left to right and generally perpendicular to the axis of rotation of the disc 10. This illustrates that it is the interaction of the magnetic fields and not the direction of rotation of the disc that controls the direction in which the molten particles are driven.

Once the individual metal particles 47 have left the point of contact between wire 30 and disc 10 there is no further driving force to accelerate them since there is no current flowing through them and thus there are no lines of magnetic flux about each as is created by the flow of current through the wire as described above. In addition, because most of the particles flung from the point of contact will be in their molten state, and thus above their Curie point, they will be nonmagnetic and will not be attracted to the pole pieces 44 and 46 of the electromagnet 14.

However, there are some particles that cool quickly and are attracted to and gather at the pole pieces 44 and 46 of the electromagnet 14. Unless some means is provided to remove these particles, they will quickly bridge across the gap 12 and block the escape path of other particles. To overcome this problem either or both of two devices may be utilized. The first is the placement of two water-cooled copper terminals 48 and 50 on the upper surfaces of pole pieces 44 and 46, respectively, held in place by cement 52 which is resistant to high temperature. These terminals are supplied with 110 volt AC power and serve to burn out any bridge of agglomerated powder particles that may tend to form across the gap 12.

A second device which acts to keep the gap 12 free from solidified metal particles which may tend to bridge between pole pieces 44 and 46 is a deeply grooved copper disc 54 mounted for rotation within gap 12 of electromagnet 14 and in close proximity to disc 10. The axis of rotation of disc 54 is parallel to that of disc 10. However, the direction of rotation of disc 54 is opposite that of disc 10, as shown by directional arrows 55 and 57, so that the adjacent peripheral surfaces of the two discs move generally in the same direction, i.e., from right to left as shown in FIG. 2. Disc 54 is rotated through pulley 56 driven by motor 20. A crossover belt arrangement is utilized to drive disc 54 in the opposite direction to that given to disc 10.

Disc 54 is mounted on water-cooled shaft 58. Rotary joints 60 and 62 serve as support bearings as well as means for getting cooling water through hollow bored shaft 58. Disc 54 may be made of copper because of its excellent heat conduction characteristics and is thus kept cool by the water flowing through shaft 58. A wiper blade 64 is installed in close proximity to the inner faces of the groove in copper disc 54 to prevent metal powder particles from adhering thereto.

The metal particles 47 flung from the area of contact between the continuously advancing wire 30 and the rotating disc 10 rapidly solidify into generally spherical shape varying in size from approximately 0.001 to 0.005 inch diameter. These particles strike against sloping wall 68 and are collected in bin 70 for periodic removal.

In the preferred embodiment disc 10 is made of graphite but it could also be made of metal of the same chemical analysis as the final powder product.

The entire apparatus may be mounted within a vacuum chamber 66 connected to vacuum outlet 67. The chamber may be a conventional steel tank with hinged and sealable doors 72 at each end. Sight viewing ports 74 may be installed in several locations along with vacuum-tight electrical and cooling water connections 76.

In operation particles of metal are produced from metal wire 30 by continuously feeding the wire toward rotating disc 10, the axis of rotation of which is substantially perpendicular to the direction of feed of the wire. The advancing end 42 of the wire is brought into contact with the rotating disc 10 within the field of an electromagnet 14 having lines of force with components substantially perpendicular to the direction of feed of the wire and substantially parallel to the axis of rotation of disc 10.

A direct electrical potential is applied between the wire and the disc causing direct current to flow through the wire and the disc, completing an electrical circuit and causing magnetic field to form around the advancing wire. This magnetic field has lines of force substantially perpendicular to the lines of force of the electromagnetic field of electromagnet 14. The current is of a magnitude sufficient to cause the end of the wire in contact with the disc to melt. Rotation of the disc together with the melting action cause the breaking of electrical contact and the formation of an arc between the end of the wire and the disc. Discrete particles 47 of the metal are driven out of the area of contact between the wire and the disc by the interaction between the magnetic field produced by the passage of current in the continuously advancing wire and the magnetic field transverse thereto produced by the electromagnet.

Continuously feeding the end of the wire against the rotating disc causes reestablishment of contact between the end of the wire and the disc. As the end of the wire reestablishes contact with the disc, additional portions of the wire are melted and the rotation of the disc once again causes formation of an arc. The making and breaking of electrical contact with the related formation of the arc are repeated at a relatively rapid rate, resulting in the production of a continuous supply of molten metal and the commensurate discharge of particles from the contact area as above described. The particles are then cooled and collected.

The entire operation may be carried out in a vacuum thus avoiding contamination of the formed metal particles.

In the preferred embodiment the material to be powdered is in the form of metal wire. However, a wire rod of substantially increased diameter could be continuously fed, with appropriate changes in the feed mechanism, against the revolving disc 10, which could also be modified to accept a rod of increased diameter. It should therefore be understood that when the term "wire" is used herein it encompasses mot only metal in flexible wire form but also metal in the form of a solid rod up to several inches in diameter.

The terms and expressions which have been employed are used as terms of description and not of limitation, and there is no intention in the use of such terms and expressions of excluding any equivalents of the features shown and described or portions thereof, it being recognized that various modifications are possible within the scope of the invention claimed.

We claim:

1. A method of producing metal particles in powder form from a metal wire which comprises the steps of a. creating a first direct current electromagnetic field in the region of a rotatable disc and having lines of force substantially parallel to the axis of rotation of said disc;

b. feeding a consumable metal wire through said first magnetic field and into contact with said disc in a direction substantially perpendicular to said lines of force of said first magnetic field;

c. applying a direct electrical potential between said wire and said disc to cause direct current flow through said wire and said disc, said current being of a magnitude sufficient to melt the end of said wire when in contact with said disc and said current causing a second magnetic field to be formed about said wire having lines of force substantially perpendicular to the lines of force of said electromagnetic field;

d. rotating said disc to break electrical contact between said wire and said disc and to cause the formation of an electrical arc between the end of said wire and said disc whereby additional portions of the end of said wire are melted;

e. continuously feeding the end of said wire against said rotating disc to reestablish contact between the end of said wire and said disc whereby a cycle of continuously making and breaking the electrical contact between said wire and said disc is established;

f. removing molten metal droplets, formed from the area of contact of said wire and said disc, by the interaction of the lines of force of said electromagnetic field and the lines of force of said second magnetic field; and g. cooling to solidification the molten metal removed fromsaid area of contact and collecting same in particle form.

2. A method of producing metal particles in powder form from a metal wire according to claim 1 wherein the process is carried out in a vacuum.

3. A method of producing metal particles in powder form from a metal wire according to claim 1, which also comprises providing an electromagnet for creating said first direct current electromagnetic field and removing solid metal particles magnetically attracted to said electromagnet.

* * * * *